United States Patent [19]

Fuji

[11] Patent Number: 4,977,431

[45] Date of Patent: Dec. 11, 1990

[54] FIXING APPARATUS AND METHOD OF CONTROLLING TEMPERATURE OF THE SAME

[75] Inventor: Kazuo Fuji, Higashiosaka, Japan

[73] Assignee: Mita Industrial Co., Ltd., Osaka, Japan

[21] Appl. No.: 258,585

[22] Filed: Oct. 17, 1988

[30] Foreign Application Priority Data

Oct. 26, 1987 [JP] Japan ..... 62-270969

[51] Int. Cl.[5] ..... G03G 15/20

[52] U.S. Cl. ..... 355/289; 219/216; 307/302; 323/366; 355/290

[58] Field of Search ..... 355/289, 290; 219/216; 323/366; 307/302, 310

[56] References Cited

U.S. PATENT DOCUMENTS

| | | | |
|---|---|---|---|
| 4,163,892 | 8/1979 | Komatsu et al. . | |
| 4,232,959 | 11/1980 | Ateya et al. | 355/290 |
| 4,373,802 | 2/1983 | Yuge et al. | 355/290 X |
| 4,427,786 | 4/1956 | Lemmerman | 323/366 |
| 4,627,813 | 12/1986 | Sasaki | 355/290 X |
| 4,684,789 | 8/1987 | Tamary | 355/290 X |
| 4,736,226 | 4/1988 | Mogi | 355/290 |
| 4,737,818 | 4/1988 | Tanaka et al. | 355/290 |

FOREIGN PATENT DOCUMENTS 2419351 3/1980 Fed. Rep. of Germany .

OTHER PUBLICATIONS

Patent Abstracts of Japan, vol. 10, No. 330 (P-514)(2386), Nov. 11, 1986; JP-A-61 134775 (Toshiba) 6-21-1986.

Patent Abstracts of Japan, vol. 7, No. 188 (P-217)(1333), Aug. 17, 1983; & JP-A-58 87575 (Ricoh) 5-25-1983.

Patent Abstracts of Japan, vol. 11, No. 56 (P-549)(2503), Feb. 20, 1987; & JP-A-61 221774 (Sharp) 10-2-1986.

Patent Abstracts of Japan, vol. 3, No. 51, (E-107)(76), Apr. 28, 1979 & JP-A-54 28638 (Ricoh) 3—3-1979.

Patent Abstracts of Japan, vol. 4, No. 27 (P-1)(509), Mar. 7, 1980; & JP-A-55 2258 (Ricoh) 1-9-80.

Patent Abstracts of Japan, vol. 3, NO. 51 (E-107)(135), Apr. 28, 1979; & JP-A-54 29650 (Ricoh) 5-3-1979.

*Primary Examiner*—A. T. Grimley
*Assistant Examiner*—Thu A. Dang
*Attorney, Agent, or Firm*—Beveridge, DeGrandi & Weilacher

[57] ABSTRACT

A fixing apparatus detects the surface temperature of a heat roller, detects either the temperature of a press roller which press-contacts the heat roller and incorporates a heater, or the temperature of an external heating apparatus which heats the exterior of the heat roller. The fixing apparatus controls the heater of the above-mentioned press roller or the above-mentioned external heating apparatus based on the results of these detections, and thereby performs a high-quality fixing operation without damaging the heat roller.

5 Claims, 5 Drawing Sheets

FIXING APPARATUS AND METHOD OF CONTROLLING TEMPERATURE OF THE SAME

BACKGROUND OF THE INVENTION

1. Field of the Invention:

The present invention relates to a fixing apparatus of an image forming apparatus such as a copying machine, and a method of controlling temperature of the same.

2. Description of the Related Art:

Hereinafter, description is made regarding a method of controlling the temperature of a conventional fixing apparatus of a copying machine.

The fixing apparatus fixes a toner image transferred onto the surface of a copy paper, and is generally installed downstream in the copy paper conveying path. This fixing apparatus has a heat roller incorporating a heater and a press roller press-contacting the heat roller, and a copy paper passes between both rollers (hereinafter referred to as "paper passing operation"), and thereby the transferred toner image is heat-pressed to be fixed on the surface of the copy paper.

The heat roller has a heater, a cylindrical core metal encircling the heater, and a flexible elastic member having such as rubber which is affixed to the outer peripheral surface of this core metal. On the other hand, the press roller is formed with the same material as the above-mentioned core metal. In the heat roller, the temperature of the core metal is detected by a contact-type thermistor, and based on the result of the detection, the above-mentioned heater is controlled to keep the temperature of the core metal nearly constant. Thereby, the surface temperature of the elastic member is maintained also at a proper temperature (for example, 185° C.).

Then, by the above-mentioned paper passing operation, heat of the surface of the elastic member is removed by the copy paper and dissipated. Intrinsically, an elastic member such as rubber has a low heat conductivity, and therefore heat from the heater in the heat roller cannot reach the surface thereof, and the surface temperature of the elastic member tends to be lower than the proper temperature. As a result, in the case of continuous copying, during the second and subsequent paper passing operations, fixing is performed at temperature (for example, 165° C.) lower than the proper temperature, sometimes resulting in unsatisfactory fixing.

In addition, also during continuous copying, when heating of the above-mentioned internal heater of the heat roller is sufficient to keep the surface temperature of the elastic member at a proper value, problems are raised in that the adhesion between the core metal and the elastic member is affected or the elastic member deteriorates.

Then, the technique of compensating for a reduction in the surface temperature of the elastic member by an external heater in place of the internal heater has been proposed, for example, in the Japanese Patent Laid-Open No. Sho 54-29650 (29650/1979).

Then, FIG. 1 is a schematic cross-sectional view of the fixing apparatus thereof.

As described above, a heat roller 1 comprises an internal heater 5, a core metal 3, an elastic member 4, and a thermistor 8 detecting the temperature of the core metal 3. Numeral 2 designates the above-mentioned press roller, and numeral 6 designates a copy paper. Furthermore, a second thermistor 9 is installed on the surface of the elastic member 4 near the inlet of the copy paper passage to detect the surface temperature of that portion of the elastic member 4. Also, an external heating roller 15 incorporating a heater 7 contacts the elastic member 4 to heat the elastic member 4.

The fixing apparatus having such construction detects a reduction (165° C.) in the surface temperature of the elastic member 4 due to paper passage by the above-mentioned second thermistor 9, and heats the member 4 by the external heating roller 15 to compensate for the reduction in temperature.

However, such a fixing apparatus has the following task to solve.

This means that during continuous paper passage, as described above, a large quantity of heat is taken away from the elastic member 4 by the copy papers, and therefore the external heating roller 15 continues heating to keep the elastic member 4 at a proper temperature (185° C.). At this time, the surface temperature of the external roller 15 reaches a temperature as high as 240° C. Now, when the paper passage ends, the heat dissipation thereof stops. Accordingly, a reduction in the temperature of the elastic member 4 does not occur.

However, the time required for a detection that heat dissipation has stopped, that is, the time required for detection of no reduction in temperature by the second thermistor 9 is the time required for the portion of elastic member, which has undergone heat dissipation, to rotate by a predetermined amount, pass through the position of contact with the external heating roller 15 and reach the place where the second thermistor 9 is located. Then, the heater 7 of the external heating roller 15 is turned off.

As a result, the temperature of the portion of the elastic member 4 undergoing no reduction in temperature, for example, 185° C. at the outlet of paper passage, is further raised by the external heating roller 15 at 240° C., and therefore far exceeds the allowable temperature of the elastic member 4, resulting in damage thereof.

SUMMARY OF THE INVENTION

The present invention provides a fixing apparatus and a method of controlling the temperature of the same to perform high-quality fixing without damaging an elastic member.

This means that the content of the present invention is:

In a method of controlling temperature of a fixing apparatus having a heat roller incorporating a heater, a press roller press-contacting the heat roller and an external heating apparatus heating the above-mentioned heat roller, a method of controlling temperature of a fixing apparatus which detects the temperatures of the above-mentioned heat roller and external heating apparatus, and controls the above-mentioned external heating apparatus based on the results of these detections.

Also, the content of the present invention is:

In a fixing apparatus having a heat roller incorporating a heater, a press roller press-contacting the heat roller and an external heating apparatus heating the above-mentioned heat roller, a fixing apparatus comprising a first detecting means for detecting the surface temperature of the above-mentioned heat roller, a second detecting means for detecting the temperature of the above-mentioned external heating apparatus and a control part which receives the results of detections by these detecting means and controls the above-mentioned external heating apparatus.

Further the content of the present invention is:

In a method of controlling temperature of a fixing apparatus having a heat roller incorporating first heating means, a press roller incorporating second heating means and press-contacting the heat roller, a method of controlling temperature of a fixing apparatus which detects the temperatures of the above-mentioned heat roller and press roller, and controls the above-mentioned press roller based on the results of these directions.

Also, the content of the present invention is:

In a fixing apparatus having a heat roller incorporating first heating means, a press roller incorporating second heating means and press-contacting the heat roller, a fixing apparatus comprising a first detecting means for detecting the surface temperature of the above-mentioned heat roller, a second detecting means for detecting the surface temperature of the above-mentioned press roller, and a control part which receives the results of the detections by these detecting means and controls the heating means of the above-mentioned press roller.

Other and further objects and advantages of the invention will appear more fully from the following description.

DESCRIPTION OF THE PREFERRED EMBODIMENTS

Figure 1:
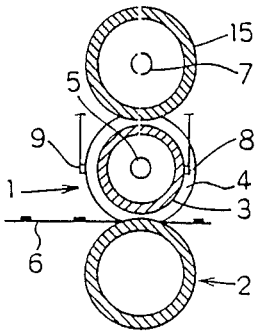
FIG.1 (PRIOR ART)
FIG. 1 is a schematic side view of a conventional fixing apparatus.
Figure 2:
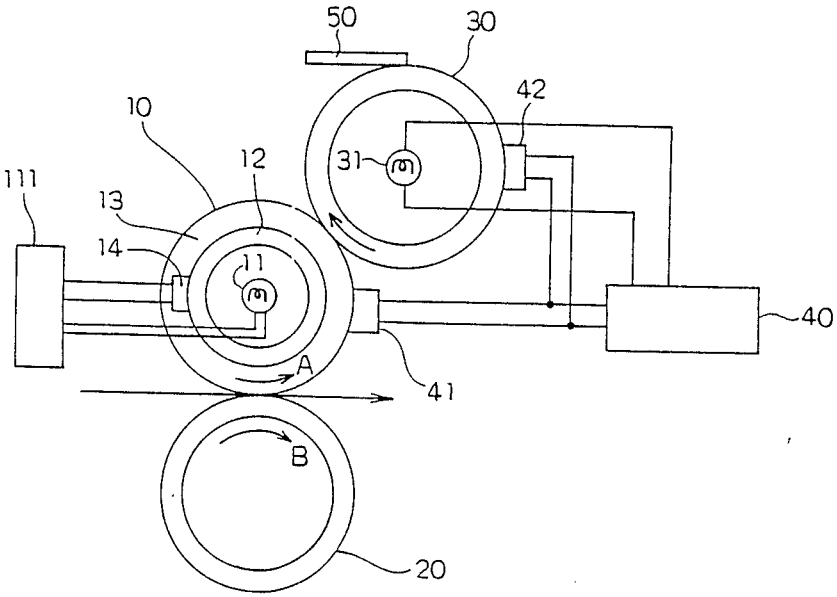
FIG. 2 is a schematic side view showing one embodiment of a fixing apparatus in accordance with the present invention.

FIG. 2 is a schematic side view showing one embodiment of a fixing apparatus in accordance with the present invention.

A heat roller 10 has a core metal 12 composed of aluminum or the like, an elastic part 13 composed of rubber or the like which is fixed to the outer peripheral surface of the core metal 12 with an adhesive or the like, and a heater 11 installed at the center of the above-mentioned core metal 12. A first detecting means 41 for detecting temperature such as a negative-characteristic thermistor is installed in contact with the surface of this heat roller 10, and between an outlet of paper passage of the elastic part 13 and an external heating apparatus 30 as described later. The heat roller 10 is rotated in the direction shown by an arrow A by a driving means such as a motor (not illustrated). In addition, numeral 14 designates a temperature detecting means consisting of a thermistor or the like which detects the surface temperature of the core metal 12. A control circuit 111 turns on or off the heater 11 based on an output signal of the temperature detecting means 14, and controls the surface temperature of the core metal 12 at a constant value (for example, 205° C.) so that the surface of the elastic part 13 is kept at a proper temperature (185° C.) when no paper is passed.

A press roller 20 contacts the above-mentioned heat roller 10, and consists of a tube of aluminum or the like coated with a synthetic resin such as Teflon (trade mark). This press roller 20 rotates in the direction shown by an arrow B following the rotation of the above-mentioned roller 10.

The external heating apparatus 30 consists of an aluminum tube coated with a synthetic resin such as Teflon, and a heater 31 is installed at the center thereof. This external heating apparatus 30 contacts the above-mentioned heat roller 10, and rotates in the direction shown by an arrow. Also, the surface of this external heating apparatus 30 is brought in contact with a second detecting means 42 consisting of a negative-characteristic thermistor or the like which detects the temperature of that surface.

In addition, a blade 50 is a means for cleaning the external heating apparatus 30.

A control part 40 is a control circuit controlling the above-mentioned heater 31 based on output signals from the above-mentioned first detecting means 41 and second detecting means 42.

Figure 3:
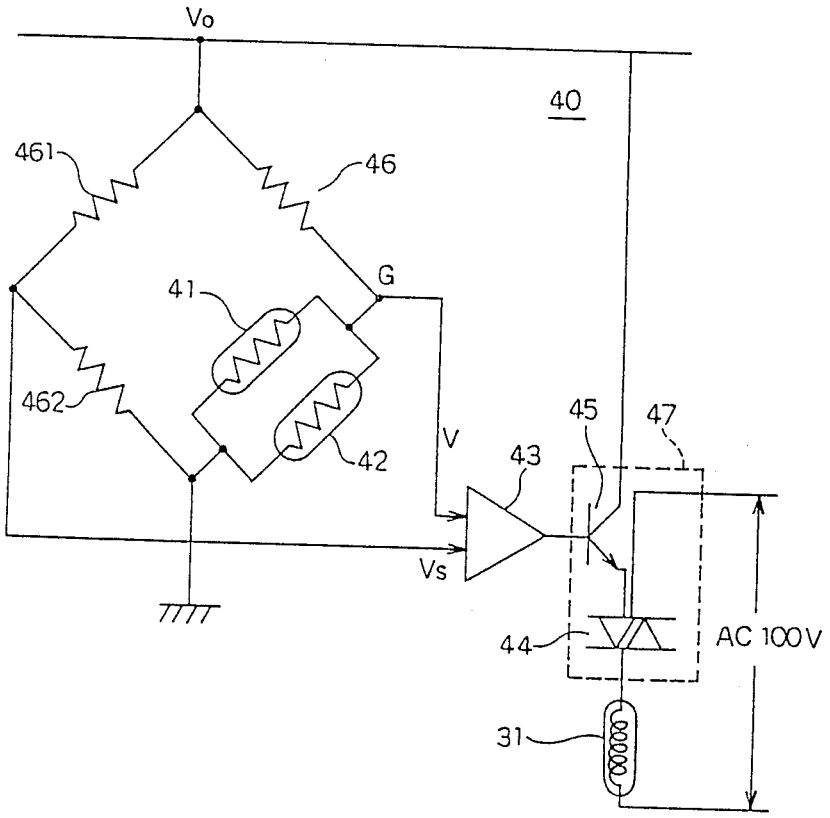
FIG. 3 is a circuit diagram of a temperature control circuit in the embodiment of FIG. 2.

FIG. 3 shows a circuit of the control part 40. The control part 40 comprises a bridge circuit 46, a comparator 43 which inputs and compares an output voltage V of this bridge circuit 46 with a reference voltage Vs and outputs a trigger signal, and an on-off means 47 turning on or off the heater 31 of the above-mentioned external heating apparatus 30 based on the trigger signal from the comparator 43.

The above-mentioned bridge circuit 46 has a parallel connection of the above-mentioned first detecting means 41 and second detecting means 42 on one side thereof. Also, the above-mentioned on-off circuit 47 comprises, for example, a transistor 45 and a triac 44, and the above-mentioned trigger signal is input to the base terminal of the transistor 45, and the emitter terminal of the transistor 45 is connected to the trigger terminal of the above-mentioned triac 44. The triac 44 is connected to the above-mentioned heater 31. The triac 44 of AC 100 V is applied to the heater 31 through the triac 44.

Next, description is made concerning operation of the above-mentioned embodiment.

First, adjustment is made in advance as follows.

Adjustment is made by the control circuit 111 so that the surface temperature of the core metal 12 is kept at 205° C. and the surface temperature of the elastic part 13 at 185° C. As a result, the resistance value of the first detecting means 41 consisting of the above-mentioned negative-characteristic thermistor becomes equivalent to 185° C., The heater 31 of the external heating apparatus 30 is turned on, and heating is performed until the surface temperature of the external heating apparatus 30 rises to 185° C. Then, at this point of 185° C., the resistance value of the second detecting means 42 consisting of the negative-characteristic thermistor becomes a value equivalent to 185° C., and a divided output voltage value is output from a connection point G by a combined resistance value of the above-mentioned parallel circuit in that case, and each resistance 461,462 of the bridge circuit 46 is set so that the divided output voltage value V equals a reference voltage Vs. This means that the adjustment is made in a manner that if the output voltage value V from the connection point G is larger than the reference voltage Vs, the comparator 43 outputs the trigger signal, and if smaller, no trigger signal is output.

Figure 4:
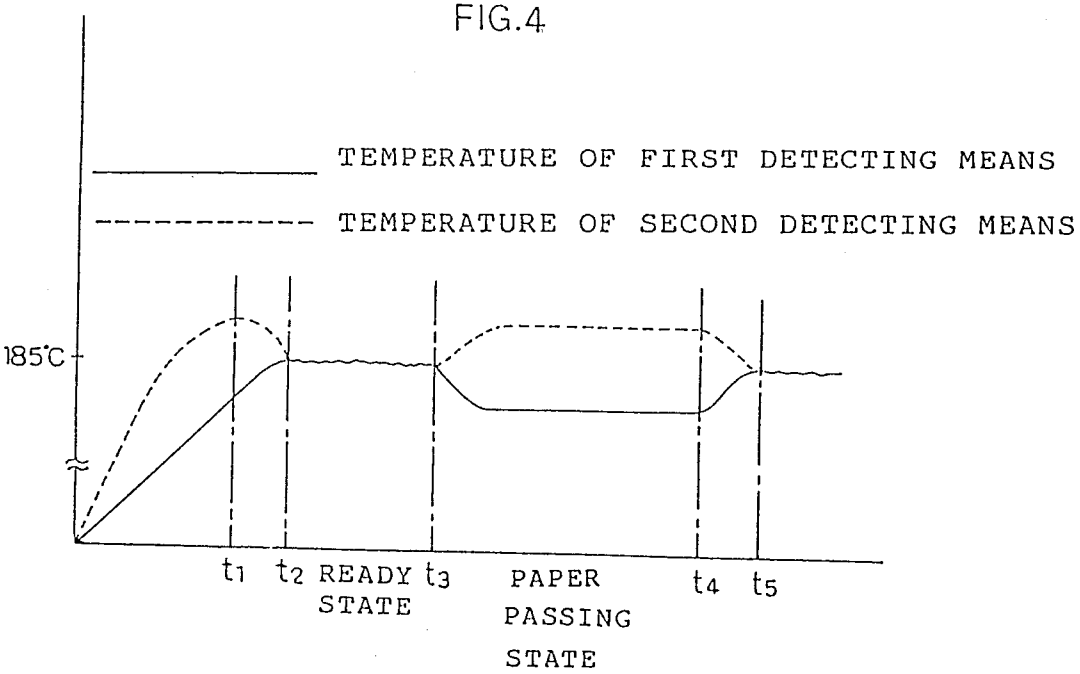
FIG. 4 is a graph showing relationships between temperature and time for an elastic part and an external heating apparatus.

FIG. 4 is a graph showing temperature changes with time of the surface of the elastic part 13 (detected by the first detecting means 41) and temperature changes with time of the surface of the external heating apparatus 30 (detected by the second detecting means 42).

Now, by turning on the power switch of the copying machine, heating by the heater 11 is started, and the first detecting means 41 and the second detecting means 42 respectively consisting of a negative-characteristic thermistor both detect low temperatures, and therefore the combined value of the parallel resistors is large. Accordingly, the divided voltage V outputted from the connection point G is large, and the comparator 43 compares it with the reference voltage value Vs, and outputs the trigger signal. As a result, the transistor 45 is put in the conductive state, and the triac 44 is triggered.

Accordingly, the heater 31 of the external heating apparatus 30 is turned on, and external heating is started.

Then, as shown by a full line in FIG. 4, the temperature of the portion of the first detecting means 41 gently rises. Also, as shown by a broken line in FIG. 4, the temperature of the portion of the second detecting means 42 shaply rises. Accordingly, the combined value of the parallel resistances becomes smaller and smaller, and when the temperature of the first detecting means 41 is 165° C. and the temperature of the second detecting means 42 reaches about 205° C., the combined value of the parallel resistances becomes equal to the above-mentioned reference combined value of the parallel resistances, and the divided voltage V agrees with the reference voltage Vs, and therefore the comparator 43 stops output of the trigger signal. Accordingly, the transistor 45 and the triac 44 are put in the non-conductive state, and the heater 31 is turned off, being put in the terminate heating state (refer to t1).

Since heating of the external heating apparatus 30 is stopped, the temperature of the second detecting means 42 falls and the resistance value thereof become larger. On the other hand, the temperature of the first detecting means 41 is further raised by heating of the heater 11, and the resistance value becomes smaller and smaller. After a while, the temperatures of the first detecting means 41 and the second detecting means 42 become 185° C., and then the combined value of the parallel resistance becomes equal to the above-mentioned reference combined value, and the apparatus is put in the ready state, and is kept in this state (refer to t2).

When continuous paper passage is started with the apparatus in such a state, the surface temperature of the elastic part 13 (the first detecting means 41) falls to 165° C. (refer to t3). Accordingly, the resistance value thereof becomes larger and the divided voltage V also becomes larger, and therefore heating by the heater 31 is performed, and the temperature of the second detecting means 42 rises. As a result, the combined value of the parallel resistances becomes equal to the above-described reference combined value, and this balanced state is maintained. This means that heat taken away by continuous paper passage is continuously supplemented dissipation the external heating apparatus 30, and thereby the surface temperature of the portion of the elastic part 13 on the upstream side (inlet side) of paper passage is maintained at 185° C., and the fixing operation is normally performed.

Next, when the paper passage ends in such a state, take-away of the heat stops, and therefore the temperature of the portion of the elastic part 13 at the outlet of paper passage rises (refer to t4). Then, the portion of the elastic part 13 whose temperature has risen soon reaches the place where the first detecting means 41 is located, and therefore the first detecting means 41 provides a smaller resistance value due to a rise in the temperature thereof. As a result, the combined value of the parallel resistances becomes small, and the divided voltage V becomes smaller. As a result, the heater 31 is turned off, and the heating is stopped. This means that the first detecting means 41 located downstream immediately detects a rise in the temperature of the elastic part 13 after completion of the paper passage, and turns off the heater 31, and therefore there is little trouble that the heater 31 additionally heats the portion of the elastic part 13 whose temperature has risen. Accordingly, the elastic part 13 can be prevented from being damaged. Then, by terminating heating, the temperature of the second detecting means 42 is reduced, and the resistance value is increased. Then, the combined value of the parallel resistances becomes equal to the above-mentioned reference combined resistance value, and a proper temperature is maintained and the apparatus is put in the ready state (refer to t5).

In addition, in the above-mentioned embodiment, no heater is installed in the press roller 20, but a heat source such as a heater may be installed. Also, in the above-mentioned embodiment, the external heating apparatus 30 is of roller shape, but is not always required to be so, and it may be a heating lamp installed in the vicinity of the heat roller 10.

Figure 5:
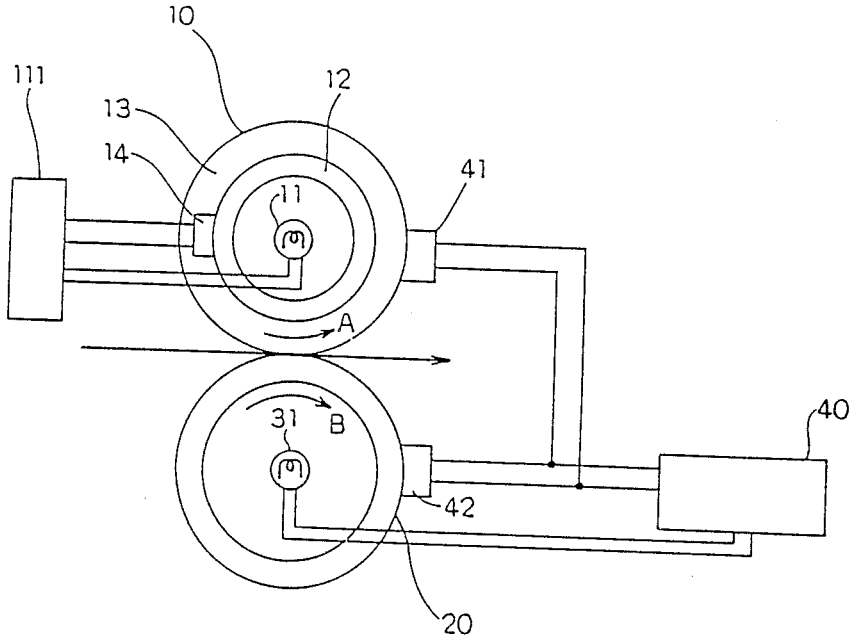
FIG. 5 is a schematic side view showing another embodiment of the fixing apparatus in accordance with the present invention.

FIG. 5 is a schematic side view of another embodiment of the fixing apparatus in accordance with the present invention.

The difference of this embodiment from the above-mentioned embodiment is that in place of the external heating apparatus 30, the above-mentioned press roller 20 functions as the supplementary heating apparatus.

This means that the above-mentioned heater 31 is installed in the press roller 20, and the above-mentioned second detecting means 42 is brought in contact with the surface of the press roller 20. The method of electrically controlling it is similar to that shown in FIG. 2.

The feature of this embodiment is that the press roller 20 performs supplementary heating from the back side of the copy paper at the nip part (paper passing portion). Where the heat is dissipated by continuous paper passage and the temperature reduction is compensated by the press roller 20, no intense heating is required unlike the first embodiment. This means that in the first embodiment, the elastic part 13 having a poor heat conductivity is heated once, and then the copy paper is heated by the elastic part 13, while in this embodiment, the copy paper is heated simultaneously from the front and back sides thereof, and therefore the heating efficiency is good.

Figure 6:
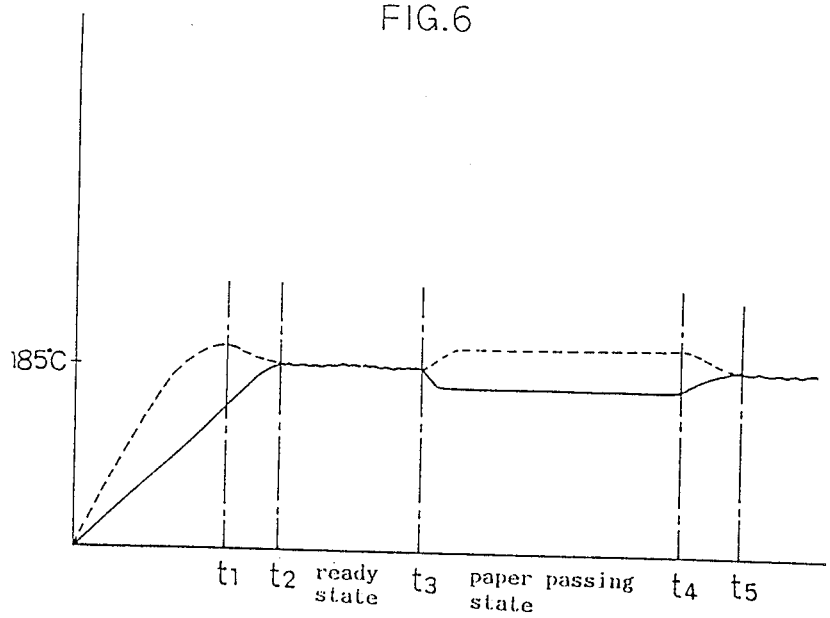
FIG. 6 is a graph showing relationships between surface temperature and time for the elastic part and the press roller in the embodiment of FIG. 5.

For this reason, heating by the heater 31 need not be as intense in comparison with the first embodiment (refer to FIG. 6). As a result, when paper passage ends, heating of the portion of the elastic part 13 whose temperature has risen, is still continued for a while until the rise in temperature is detected by the first detecting means 41 and the second detecting means 42, but this heating is not intense as described above, and therefore the elastic part 13 is never adversely affected. In addition, after the rise in temperature has been detected by the first detecting means 41 and the second detecting means 42, heating by the heater 31 is stopped, and further, the apparatus is put in the ready state.

In addition, by locating the first detecting means 41 as close to the outlet of the paper passage as possible, unnecessary heating time can be made as short as possible.

In addition, since the heat is installed in the press roller 20, increasing heat dissipation from the press roller 20 with increasing copy paper speed is avoided as compared with the above-mentioned case in which the heater is not installed in the press roller 20, and therefore a good fixing can be realized.

Furthermore, while the control part 40 uses the parallel circuit of the bridge circuit in the first and second embodiments, the control part 40 can be realized by using a microcomputer. That is, for example in the first embodiment, when the detected resistance of the first detecting means 41 is R1 and the detected resistance of the second detecting means 42 is R2, the microcomputer receives the resistance values R1, R2 and calculates according to the equation, $$R = \frac{1}{(1/R1) + (1/R2)},$$

and compares the value R with Vs and outputs the result to the on-off circuit 47. The Vs is 0.59 kΩ derived from the equation, $$R = \frac{1}{1/1.18 + 1/1.18} = 0.59.$$

Here each resistance of the detecting means 41 and 42 is 1.18 kΩ when the surface temperature of the heat roller 10 is 185° C. and the surface temperature of the press roller 20 is 185° C.

As in the above-mentioned embodiment, the present invention can be put into practice using a microcomputer.

While the preferred form of the present invention has been described, it is to be understood that modifications will be apparent to those skilled in the art without departing from the spirit of the invention.

I claim:

1. A fixing apparatus having a heat roller incorporating a heater, a press roller press-contacting said heat roller, and an external heating apparatus for heating said heat roller, said apparatus comprising:

a first detecting means for detecting a surface temperature of said heat roller, a second detecting means for detecting a temperature of said external heating apparatus, and a control part which receives results of detection by said first detecting means and second detecting means and controls said external heating apparatus, said control part comprising a bridge circuit including a parallel resistance circuit formed by said first detecting means and said second detecting means, said bridge circuit providing an output which depends upon variations in a combined resistance of said first and second detecting means in said parallel circuit, a comparator for comparing an output of said bridge circuit with a reference voltage, and an on-off means for turning said external heating apparatus on or off according to an output from said comparator.

2. A fixing apparatus in accordance with claim 1, wherein said external heating apparatus is a roller which contacts the heat roller and which incorporates a second heater.

3. A fixing apparatus in accordance with claim 1, wherein said external heating apparatus is a heating lamp installed in the vicinity of said heat roller.

4. A fixing apparatus in accordance with claim 1, wherein said first detecting means is located between a paper passage outlet portion and said external heating apparatus.

5. A fixing apparatus having a heat roller incorporating a first heating means and a press roller which press-contacts said heat roller, said press roller incorporating a second heating means, said apparatus comprising:

a first detecting means for detecting a surface temperature of said heat roller, a second detecting means for detecting a surface temperature of said press roller, and a control part which receives the results of detections by said first detecting means and second detecting means and controls said second heating means of said press roller, said control part comprising a bridge circuit including a parallel resistance circuit formed by said first detecting means and said second detecting means, said bridge circuit providing an output which depends upon variations in a combined resistance of said first detecting means and second detecting means in said parallel circuit, a comparator for comparing an output of said bridge circuit with a reference voltage, and an on-off means for turning said heating means of said press roller on or off according to an output from said comparator.

* * * * *